United States Patent [19]

Ogawa

[11] Patent Number: 4,637,812

[45] Date of Patent: Jan. 20, 1987

[54] APPARATUS FOR FOLDING WEB-SHAPED MEMBER

[75] Inventor: Kenji Ogawa, Musashino, Japan

[73] Assignee: Idemitsu Petrochemical Co., Ltd., Tokyo, Japan

[21] Appl. No.: 649,391

[22] Filed: Sep. 11, 1984

[51] Int. Cl.[4] ..... B05B 1/14

[52] U.S. Cl. ..... 493/357; 493/410; 493/437; 29/33 K; 412/33; 412/38

[58] Field of Search ..... 493/393, 394, 411–417, 493/422, 437, 448, 447, 451, 383–385; 412/33, 38; 29/33 K; 198/631, 796; 281/25 R; 226/156; 402/80 R; 292/253

[56] References Cited

U.S. PATENT DOCUMENTS

| | | | |
|---|---|---|---|
| 1,217,668 | 2/1917 | Trombower | 292/253 |
| 1,768,534 | 7/1930 | Aiken | 198/796 |
| 4,227,684 | 10/1980 | Brocklehurst | 493/437 |
| 4,281,445 | 8/1981 | Barber et al. | 402/80 R |
| 4,311,228 | 1/1982 | Moltrasio | 198/796 |
| 4,507,109 | 3/1985 | Meschi | 493/412 |

FOREIGN PATENT DOCUMENTS

| | | | |
|---|---|---|---|
| 96948 | 6/1982 | Japan . | |
| 142872 | 9/1982 | Japan . | |
| 99372 | 6/1983 | Japan . | |
| 0125569 | 7/1983 | Japan | 493/415 |
| 130862 | 8/1983 | Japan . | |
| 128162 | 7/1984 | Japan . | |

*Primary Examiner*—Lowell A. Larson
*Assistant Examiner*—Robert Showalter
*Attorney, Agent, or Firm*—Flynn, Thiel, Boutell & Tanis

[57] ABSTRACT

An apparatus for folding a web of plastic film at predetermined locations and in a Z-shaped manner. The apparatus, by use of a mechanism for supplying the web material, has a pair of film feeding arms supplying the web material to the folded end portions in such a manner that the web material is pressed from front and rear surfaces different from each other, guided and supplied to the folded end portions, the web material is alternately guided around folded end holding members linearly movable at least from one side in the widthwise direction of the web material out of and into the respective folded end portions.

8 Claims, 19 Drawing Figures

FIG. 10A
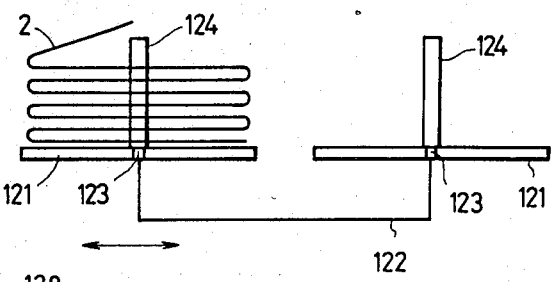
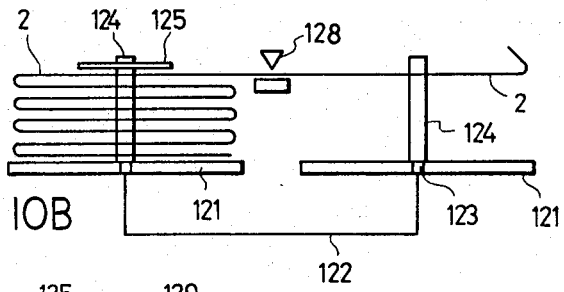
FIG. 10B
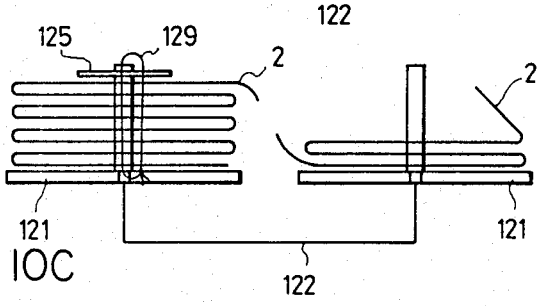
FIG. 10C
FIG. 10D
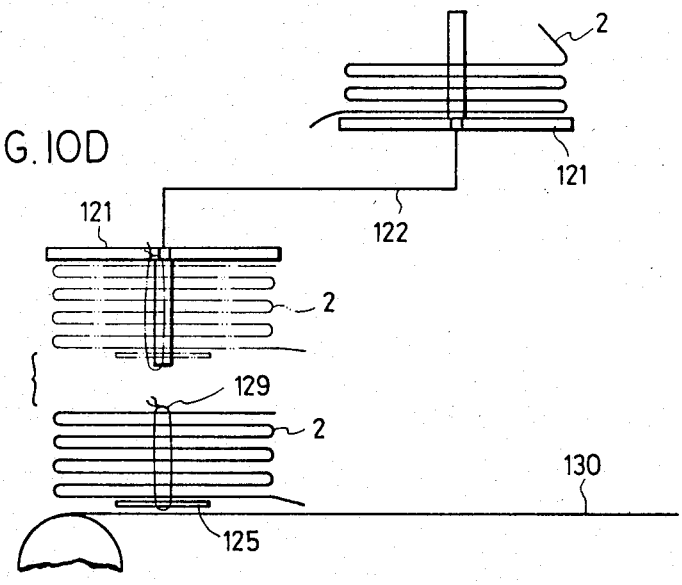

APPARATUS FOR FOLDING WEB-SHAPED MEMBER

CROSS REFERENCE TO RELATED APPLICATION

The subject matter of this application is ralated to U.S. application Ser. No. 456,228, filed on Jan. 7, 1983, now U.S. Pat. No. 4,592,739, issued June 3, 1986.

BACKGROUND OF THE INVENTION

1. Field of the Invention

This invention relates to an apparatus for folding a web-like member formed of a plastic film or the like into sections of a predetermined length in a Z-shaped manner.

2. Description of the Prior Art

In recent years, plastic bags have been utilized in large quantities as wrapping materials because the plastic bags can be mass produced sanitarily and inexpensively. Furthermore, there has been proposed a construction wherein a member in which plastic bags described above are continuously arranged (hereinafter referred to as a "plastic continuous bag-shaped member" or simply as a "continuous bag-shaped member") are folded in a Z-shaped manner, contained in a cardboard box or the like and each section of the plastic bags can be taken out one section after another in the same manner as in the case of pop-up take-out tissue paper (Japanese Patent Kokai (Laid-Open) Nos. 96948/82, 142872/82 and Japanese Patent Application No. 194404/81).

Now, as the apparatus for folding the continuous bag-shaped member in a Z-shaped manner, there have been proposed by the present applicant apparatuses, each of which comprising a folded end holding member linearly movable at least from one side in the widthwise direction of the web-shaped member of the respective folded end positions of the continuous bag-like member as being the web-shaped member to the folded end position and vice versa and a web-shaped member supplying mechanism for supplying the web-shaped member for alternately guiding the web-shaped member around the folded end holding member while reciprocating in the longitudinal direction of the web-shaped member between the folded end positions in a rectilinear or a circularly arcuate manner (both of which correspond to U.S. application Ser. No. 456,228 filed Jan. 7, 1983) (Japanese Patent Application Nos. 7125/82, and 9788/82 (both of which correspond to U.S. application Ser. No. 456,228 filed Jan. 7, 1983) and 1886/83). The folding apparatuses thus proposed have been advantageous in that there is no possibility of damageing the web-shaped member, and moreover, the web-shaped member can be folded reliably and at high speed. However, since the supplying mechanism reciprocates between the folding end positions, it has been difficult to prevent the folded end holding member from colliding with the supplying mechanism. Furthermore, it has also been difficult in that the supplying mechanism and the holding member are operated by a common driving source. Needless to say, the proposed apparatuses have obviated the above-described difficulties, however, the constructions of the apparatuses as a whole have been complicated.

SUMMARY OF THE INVENTION

An object of the present invention is to provide an apparatus for folding a web-shaped member, wherein the apparatus as a whole is simplified in construction and the web-shaped member is reliably and quickly folded.

Another object of the present invention is to provide an apparatus for folding a web-shaped member, having a mechanism capable of receiving a successively folded web-shaped member continuously or once every predetermined number of sections.

To the above end, the present invention contemplates that, differing from the aforesaid proposed apparatuses having the supplying mechanism reciprocating between both folded end positions, there is provided a mechanism for supplying a web-shaped member, which supplies the web-shaped member to the folded end positions in such a manner that the web-shaped member is pressed from front and rear surfaces different from each other, guided and supplied to the folded end positions by a pair of film feeding arms alternately rocking toward the folded end positions of the web-shaped member, the web-shaped member is alternately guided around a folded end holding member linearly movable at least from one side in the widthwise direction of the web-shaped member out of the respective folded end positions of the web-shaped member to the folded end position, and these supplying mechanism and the folded end holding member can operate with no collisions occurring therebetween, so that these supplying mechanism and the folded end holding member can be simplified in connection and interlocking construction.

To the above end, the present invention contemplates that, in addition to the above arrangement, a bearer of a stock mechanism is provided at a position where the web-shaped member is successively folded in a manner to descend continuously, so as to be able to receive the web-shaped member continuously, or a plurality of bearers or receiving surfaces are movably provided at a position where the web-shaped member is successively folded or positions spaced apart from the aforesaid folded position, and there are provided devices for cutting the web-shaped member being continuous between the plurality of bearers or receiving surfaces.

In addition to the arrangement to achieve the aforesaid another object, there is provided a device for tying the web-shaped member, the aforesaid another object can be achieved in a better way.

BRIEF DESCRIPTION OF THE DRAWINGS

FIGS. 10(A) to 10(D) are views illustrating another embodiment of the one set folding method in various actuated positions with the schematic block diagrams being shown;

DETAILED DESCRIPTION OF THE PREFERRED EMBODIMENTS

Description will hereunder be given of the embodiments of the present invention with reference to the drawings.

Figure 1:
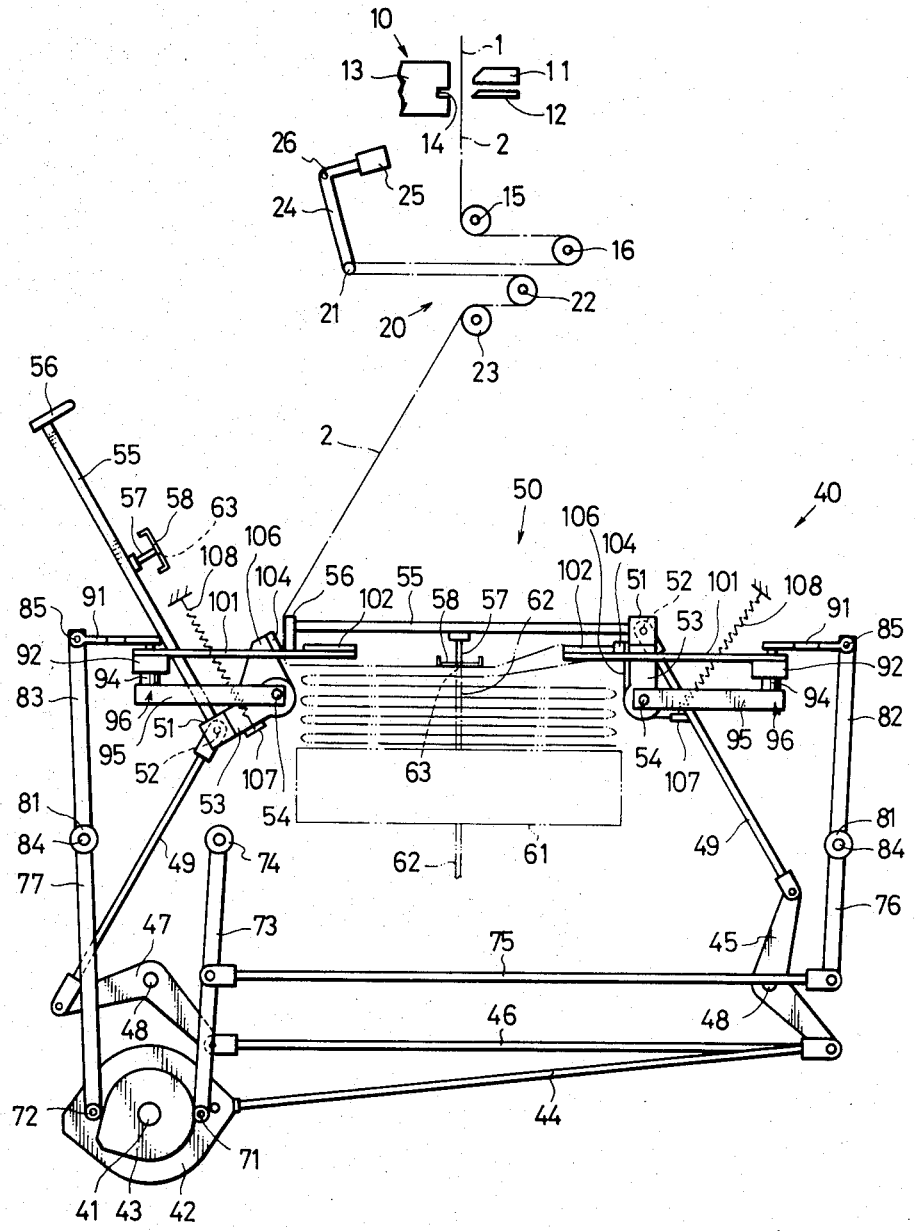
FIG. 1 is a front view showing the general arrangement of one embodiment where the apparatus for folding the web-shaped member according to the present invention is combined with a bag making machine, with the frame being omitted.
Figure 2:
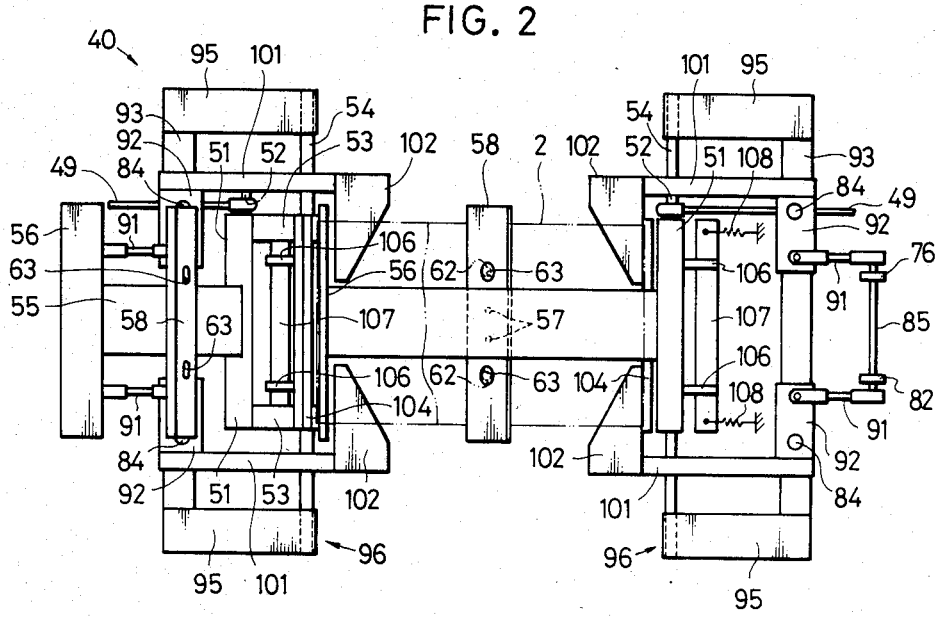
FIG. 2 is a plan view showing the apparatus for folding the web-shaped member.

FIG. 1 shows one embodiment of the apparatus for folding a web-shaped member according to the present invention. A bag making machine 10 is installed on a frame, not shown, formed by combining H steels and the like with one another, and assembled into this frame are a tension adjusting mechanism 20 and a folding apparatus 40 according to the present invention. Additionally, FIG. 2 is a plan view showing this folding apparatus 40.

Continuously fed into the bag making machine 10 is a plastic web-shaped member 1 as being a web-shaped member from a so-called raw fabric. This plastic web-shaped member 1 is a flattened tubular film formed by a tubular film process or the like. The bag making machine 10 includes: a heat sealer 11; a cutter 12 provided in the neighborhood of the heat sealer 11, for forming perforated lines and linear cuts, which will be described hereunder, in the web-shaped member, and a receiving block 13 spaced a predetermined distance apart from the heat sealer 11 and the cutter 12 in opposed relationship thereto. The heat sealer 11 and the cutter 12 are arranged to be linearly movable to and from the receiving block 13 through the plastic web-shaped member 1. The receiving block 13 is formed with a slit 14, into which the forward end of the cutter 12 is inserted.

Figure 3:
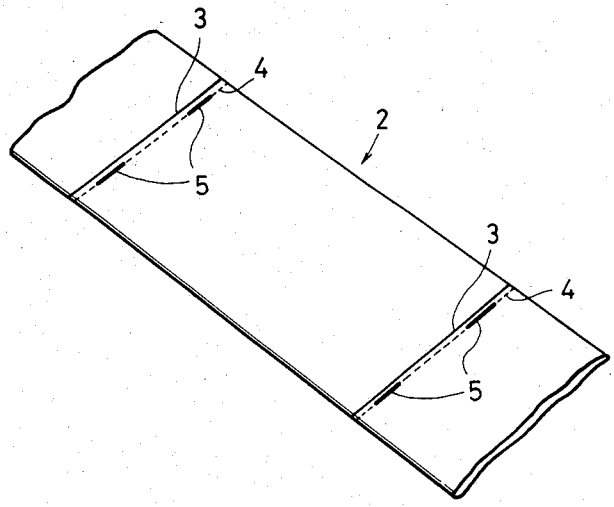
FIG. 3 is a perspective view showing one example of a part of the continuous bag-shaped member worked on by the bag making machine in the above embodiment.

Both the heat sealer 11 and the cutter 12 advance toward the receiving block 13 each time the plastic web-shaped member 1 is fed by a predetermined value, whereby the plastic web-shaped member 1 is formed into a continuous bag-shaped member 2 (remaining still in the web-shaped member) as shown in FIG. 3. More specifically, the plastic web-shaped member 1 has its opposing surfaces fusion-bonded by a predetermined length in the widthwise direction thereof by means of the heat sealer 11, whereby a sealed portion (bag bottom portion ) 3 is formed. At the same time, the plastic web-shaped member 1 is formed thereon with perforated lines 4 and two linear cuts 5 similarly in the widthwise direction thereof at every predetermined length by means of the cutter 12. In consequence, by separating the continuous bag-shaped member 2 away along the perforated lines 4, there is obtained a plastic bag having the perforated lines as an opening edge and the sealed portion 3 as a bag bottom portion.

The continuous bag-shaped member 2 formed by the bag making machine 10 passes through a guide roll 15 fixed to the frame and a position adjusting roll 16 being adjustable in the horizontal direction in FIG. 1 and is supplied to a tension adjusting mechanism 20 provided upwardly of the folding apparatus 40.

This tension adjusting mechanism 20 includes: a dancer 21 formed of a roller, a rod or the like, around which is guided the continuous bag-shaped member 2, which has been guided around the position adjusting roller 16; a reversing roll 22; and a guide roll 23 affixed to a predetermined position on the frame. The continuous bag-shaped member 2 passes through the dancer 21, the reversing roll 22, the guide roll 23 and is delivered to the folding apparatus 40. The dancer 21 is mounted to one end of a rocking link 24. The rocking link 24 is of an L-shape for example, fixed at the other end thereof with a weight 25, and rockingly supported at its bent portion on the frame through a support shaft 26. Any looseness of the continuous bag-shaped member 2 may be absorbed by the dancer 21.

The surface of the reversing roll 22 is formed of a very smooth metal surface, and this reversing roll 22 is rotated in a direction opposite to the feeding direction of the continuous bag-shaped member 2 all the time. The motion of the dancer 21 for absorbing any looseness of the continuous bag-shaped member 2 is very quickly carried out by this reversing roll 22.

The continuous bag-shaped member 2 is supplied to a folding apparatus 40 according to the invention after having passed through the tension adjusting mechanism 20.

The folding apparatus 40 is provided with a rotary driving source such as a motor, not shown. An output shaft of this rotary driving source or an output shaft of a change gear or the like, not shown, connected to the output shaft of this rotary driving source is shown as a drive shaft 41 in FIG. 1. Fixed to this drive shaft 41 are cam-type rotary board 42 and a cam 43. Connected to the rotary board 42 through a cam follower, a link and the like, not shown, is a linearly movable shaft, not shown, of the heat sealer 11 and cutter 12 of the bag making machine 10, whereby the heat sealer 11 and cutter 12 are linearly moved at a predetermined timing by the rotation of the rotary cam plate 42. Furthermore, rockingly connected to the rotary cam plate 42 is one end of a first driving rod 44, the other end of which is rockingly connected to one end of a link 45 being of a shallow V-shape or the like.

Furthermore, rockingly connected to the aforesaid end of the link 45 is one end of a second driving rod 46, the other end of which is rockingly connected to one end of a link 47 being identical in shape with the link 45. The two links 45 and 47 are positioned at heights equal to each other in FIG. 1, and are rockingly supported on the frame through mounting shafts 48, respectively.

Connected to the other ends of the links 45 and 47 are the ends of the arm driving rods 49 on, respectively.

Figure 4:
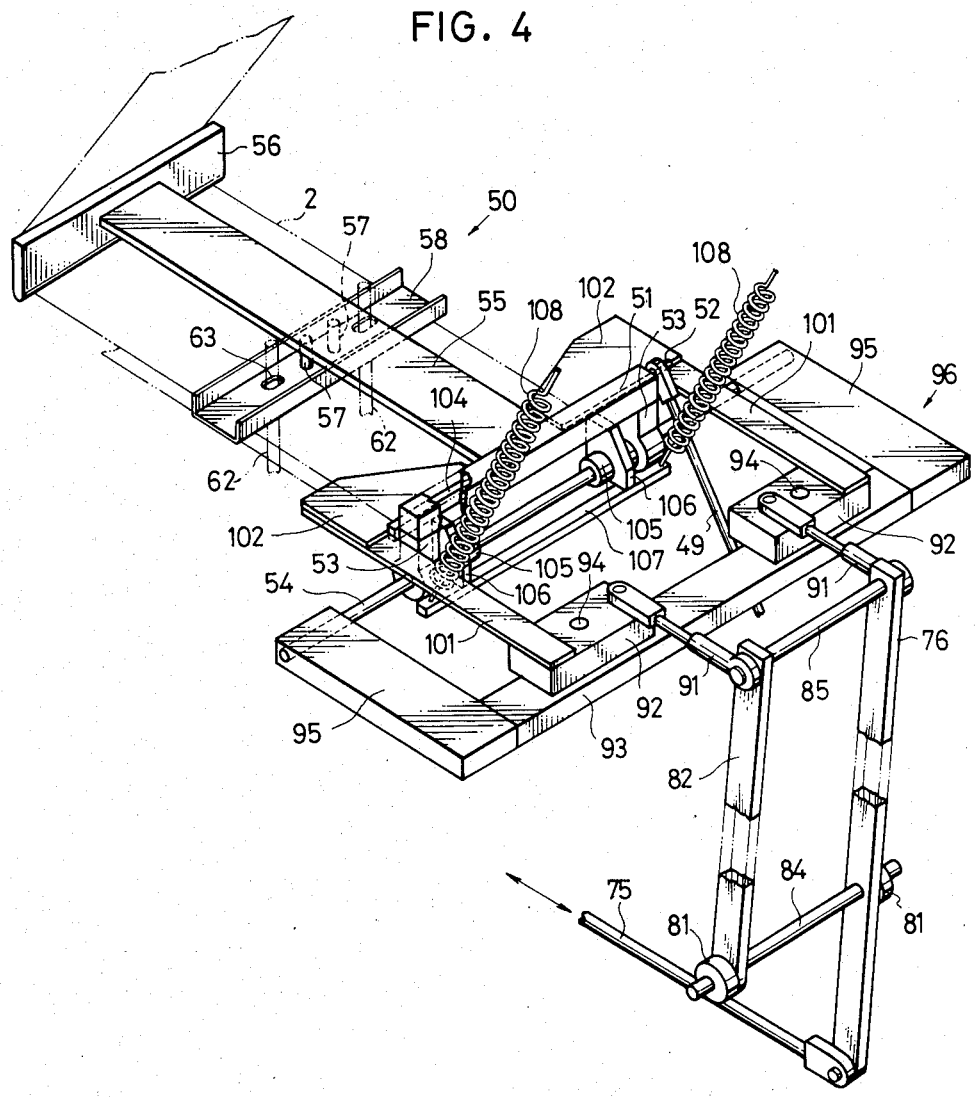
FIG. 4 is a perspective view enlargedly showing the essential portions of the above embodiment.

Description will hereunder be given of each of the arrangements of the other ends of these two arm driving rods 49, simultaneously. Namely, as shown in FIG. 4, a square rod-shaped proximal end block 51 having a predetermined length is connected to the end of the arm driving rod 49 through a connecting shaft 52 projecting from an end of the proximal end blocks 51.

The proximal end block 51 is provided at opposite ends thereof with pillow shaped legs 53, through which a support shaft 54 is rotatably inserted, whereby, when the rotary cam plate 42 is rotated, the turning force is imparted to the proximal end block 51 via the rods 44 and 46, links 45 and 47, and arm driving rod 49, so that the proximal end block 51 is rocked about the support shaft 54 at a predetermined timing.

Fixed to side surfaces of these proximal end blocks 51 facing toward each other are proximal ends of film feeding arms 55, which are adapted to rock (falling down⇄erecting) about the support shafts 54 as the proximal end blocks 51 rock. Fixed at the forward end of each film feeding arm 55 at the right angles with the film feeding arm 55 (in the widthwise direction of the continuous web-shaped member 2) is an end push plate 56 being of a predetermined width. The bottom end edge of this end push plate 56 is of a roundish shape.

This end push plate 56 is adapted to be located at one of the two folded end positions of the continuous bag-shaped member 2 when the film feeding arm 55 falls down into the horizontal direction. More specifically, as the film feeding arm 55 rocks from the erected state to the fall-down state, the end push plate 56 abuts against one side surface of the continuous bag-shaped member 2 stretched from the tension adjusting mechanism 20 to the folding apparatus 40, then guides and delivers the continuous bag-shaped member 2 to one of the folded end positions, after taking over the continuous bag-shaped member 2 from the tension adjusting mechanism 20. Here, the blocks 51, legs 53, arms 55 and end push plates 56 constitute a supplying mechanism 50 for alternately guiding the continuous bag-shaped member 2 in a manner to press the same from either side and finally delivering the same to the folded end positions.

Figure 5:
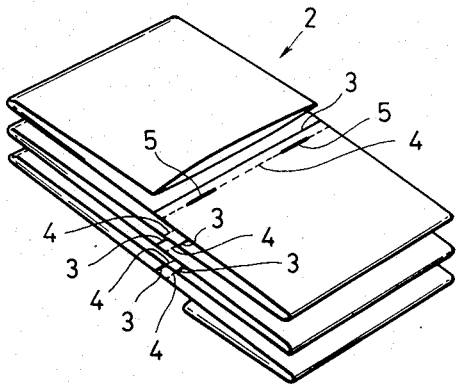
FIG. 5 is a perspective view showing the folded state of the continuous bag-shaped member.

Secured to the substantially central position in the longitudinal direction at the bottom face of the film feeding arm 55 through mounting pins 57 is a keep plate 58 disposed in a direction perpenducular to the longitudinal direction (the widthwise direction of the continuous bag-shaped member 2). Each keep plate 58 presses the substantially central portion of the continuous bag-shaped member 2, which has been folded and placed in layers on a bearer 61 (Refer to FIG. 1) of a stacking mechanism, to the bearer 61. Bar-shaped insert members 62 projectingly provided on a truck, not shown and extending through the bearer are upwardly projected from the top end face of the bearer 61. These insert members 62 are inserted through the linear cuts 5 (Refer to FIG. 5) superposed on one another of the continuous bag-shaped member 2 placed in layers on the top of the bearer 61, and the forward end portions of these insert members 62 are loosely coupled into relief holes 63 formed at predetermined positions of each keep plate 58. Furthermore, the bearer 61 is constructed such that, along with the progress of the folding operation, the bearer 61 decends by gravity in operational association with the folding operation, or is lowered by the pressing force of the keep plate 58.

The cam 43 is a circumferential cam, and two cam followers 71 and 72 clampingly engage the cam surface of this cam 43 from both sides in the substantially diametral direction. One of the cam followers 71 is secured to a rocking end of a connecting rod 73, the other end of which is rockingly secured to the frame through a stationary bearing 74. Rockingly connected to a predetermined position in the longitudinal direction of the connecting rod 73 is one end of a connecting rod 75, the other end of which is rockingly connected to the bottom end of a rocking rod 76.

The other of the cam followers 72 is secured to the bottom end of a rocking rod 77. For example, this rocking rod 77 and the connecting rod 73 are connected to each other through a tension coil spring, not shown, whereby the two cam followers 71 and 72 are not separated from the cam 43 all the time.

Top end portions of the two rocking rods 76 and 77 are disposed at heights substantially equal to each other and rockingly supported at respective predetermined positions in the longitudinal directions thereof to the frame through stationary bearings 81. Parallel rods 82 and 83 each having a predetermined length are arranged in parallel to the rocking rods 76 and 77, respectively. Bottom end portions of the parallel rods 82 and 83 are fixed to predetermined positions in the longitudinal directions of the rocking rods 76 and 77 through transversely racked shafts 84, and top end portions of the parallel rods 82 and 83 are fixed to top end portions of the rocking rods 76 and 77 through transversely racked rods 85, respectively.

The transversly racked rods 85 provided at the right and left sides in FIG. 1 will hereunder be collectively described.

As shown in FIG. 4, connected to opposite end portions of the transversely racked rod 85 are ends of connecting shafts 91 on one side, respectively, and the other ends of these connecting shafts 91 are connected to predetermined positions of connecting pieces 92. Each connecting piece 92 is supported by a rotary shaft 94 projected from the top end face of the connecting block 93 in a manner to be rotatable on a hypothetical plane in the horizontal direction. Support blocks 95 are fixed to opposite end portions of the connecting block 93, respectively, and the support shaft 54 is racked across predetermined positions on these support blocks 95. Here, the blocks 93, 95 and support shaft 54 constitute a base block 96, which is supported on the frame in a manner to be adjustable in mounted position in the horizontal direction. In other words, the two base blocks 96 disposed in the right and left in FIG. 1 are adjustable in the interval therebetween, so that the folding width of the web-shaped member 1 to be described hereunder, which is folded in a Z-shaped manner can be adjusted.

Proximal end portions of openable arms 101 are fixed to the two connecting pieces 92, respectively. A pair of openable vanes 102 as being folding end holding members are fixed to the forward end portions of these openable arms 101, respectively. These openable vanes 102 are disposed on one and the same hypothetical plane in the horizontal direction, on-off operated on the hypothetical plane by the rotation of the connecting pieces 92, further, in the closed state, side edges of the openable vanes 102 on one side are located at the folding end positions of the continuous bag-shaped member 2, and, in the flared state, the forward ends of the openable vanes 102 are separated from each other by a predetermined length in addition to the length in the widthwise direction of the continuous bag-shaped member 2.

A folding end receiving member 104 is in abutting contact with side edges along the folding end positions of the openable vanes 102 in the closed state, and the continuous bag-shaped member 2 is clamped between the folding end receiving member 104 and the openable vanes 102, whereby a folded end portion is reliably formed on the continuous bag-shaped member 2. The folded end receiving member 104 is fixed to two rotatable pieces 106 each having a bearing 105 rotatably coupled onto the support shaft 54. Namely, the folded end receiving member 104 is rotatably supported on the support shaft 54 through the rotatable pieces 106. A stopper 107 is fixed to the rotatable pieces 106. Fixed to this stopper 107 are ends of tension coil springs 108 on one side as biasing means, respectively. Ends of the coil springs 108 on the other side are fixed to the frame. The folded end receiving member 104 is constantly biased toward the folded end position by the spring 108, however, the legs 53 are capable of being abutted against the stopper 107, and, when the legs 53 are in predetermined rotatable positions, the legs 53 come into abutting contact with the stopper 107, whereby the stopper 107 is forcedly rotated in the rotating directions of the legs 53, so that also the folded end receiving member 104 can be rotated in a direction of receding from the folded end position against the biasing forces of the springs 108.

Description will hereunder be given of action of this embodiment with reference to FIGS. 6(A) to 6(D).

Due to rotations of the rotary cam plate 42 and the cam 43, the pair of openable vanes 102 provided at the both folded end portions, respectively, are on-off operated at a predetermined timing and the two film feeding arms 55 rock between the erected state and the fall-down state, avoiding collisions with each other, in operational association with the timing of the on-off operation of the openable vanes 102. On the other hand, the bag making working in the bag making machine 10 is carried out by means of the driving source commonly used with the folding apparatus 40 as described above, and operated in operational association with the predetermined timing of the folding operation in the folding apparatus 40.

One end of the plastic web-shaped member 1 is pulled out of the raw fabric, passed through the bag making machine 10, position adjusting roll 16 and tension adjusting mechanism 20. The one end thus pulled out is fixed to the bearer 61 or the like of the stacking mechanism, and thereafter, the operations in the bag making machine 10 and the folding apparatus 40 are started. In the bag making machine 10, the plastic web-shaped member 1 is formed at each predetermined length thereof with a sealed portion 3, perforated lines 4 and linear cuts 5, to thereby provide the continuous bag-shaped member 2. The continuous bag-shaped member 2 is folded onto the bearer 61 by the film feeding arms 55.

Figure 6C:
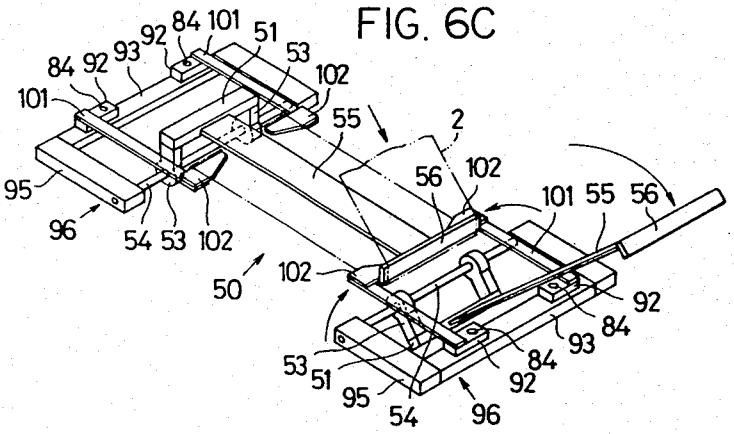
FIGS. 6(A) to 6(D) are perspective views showing the conditions of the different folding operations in the above embodiment.
Figure 6D:
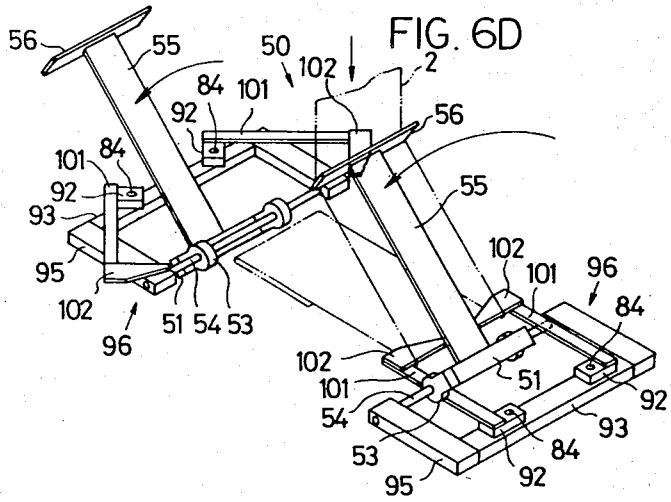
Figure 6A:
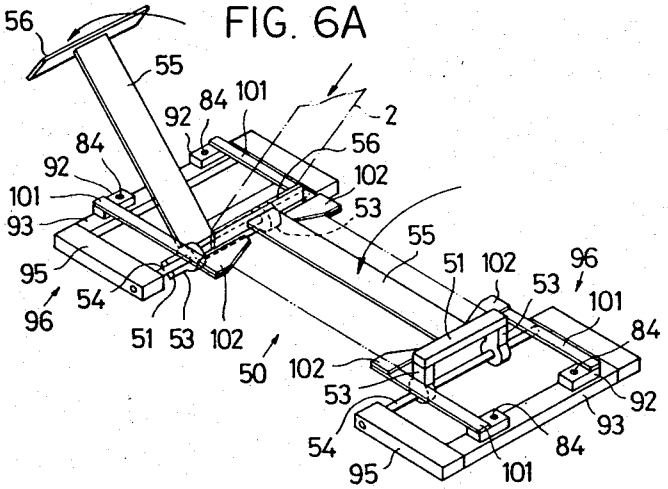

FIG. 6(A) shows the operating conditions of the film feeding arms 55 and the openable vanes 102 corresponding to the operating conditions as shown in FIG. 1. In this drawing, the film feeding arm 55 on right side in the drawing falls down at the folded end position on the left side in FIG. 1, and a folded end portion is about to be formed on the continuous bag-shaped member 2 by the end push plate 56 on the forward end of this film feeding arm 55. The openable vanes 102 on the left side in FIG. 1 are closed and positioned at positions inwardly of the end push plate 56 (on the side of the proximal end of this film feeding arm 55), and, as shown in FIG. 1, the folded end receiving member 104 is retracted to a position receded by a predetermined length from the folded end portion on the left side. More specifically, the legs 53 of the proximal end block 51 is rotated in the counterclockwise direction in FIG. 1, whereby the rotatable pieces 106 are forcedly rotated in the counterclockwise direction against the spring 108 by the stopper 107 being in abutting contact with the legs 53, so that the folded end receiving member 104 is retracted in the aforesaid direction.

Figure 6B:
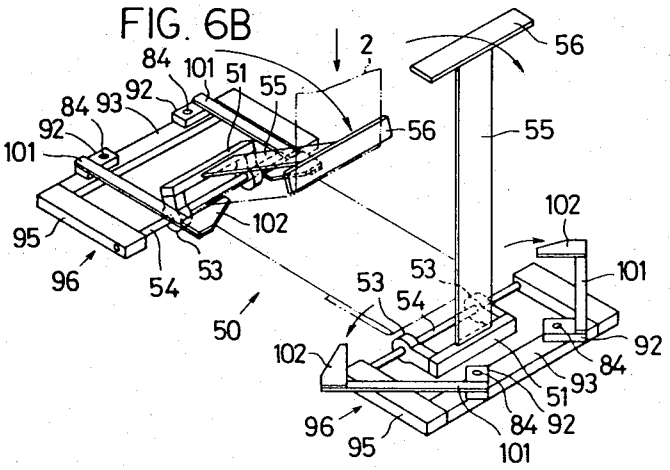

Subsequently, as shown in FIG. 6(B), the film feeding arms 55, which have been in the fall-down state, are rocked in the erecting direction, and the rocking arms on the left side in FIG. 1 are rocked from the erected state to the fall-down state. The continuous bag-shaped member 2 supplied from the tension adjusting mechanism 20 is guided to the folded end position on the right side in the drawing by the end push plate 56 on the foward end of the film feeding arm 55 directed to the fall-down state. At this time, the pair of openable vanes 102 on the left side are held in the closed state. In consequence, as the film feeding arm 55 moves toward the fall-down state, the continuous bag-shaped member 2 is guided around the openable vanes 102. In this case, the pair of openable vanes 102 on the right side moves from the closed state to the flared state.

The legs 53 of the proximal end block 51, supporting the proximal end of the film feeding arm 55 on the left side are rotated in the clockwise direction, whereby the stopper 107 engaged with the legs 53 is rotated in the clockwise direction, i.e. the folded end receiving member 104 moves to the folded end position by the biasing force of the tension coil spring 108, so that the continuous bag-shaped member 2 can be firmly clamped between the folded end receivng member 104 and the openable vanes 102, thus enabling a forming of a fold in the widthwise direction on the continuous bag-shaped member 2.

When the film feeding arm 55 on the left side in the drawing completely falls down as shown in FIG. 6(C), the openable vanes 102 on the right side are closed in a state where the openable vanes 102 are located at positions inwardly of the proximal end of the end push plate 56 on the forward end of the film feeding arm 55, which has fallen down. At this time, the film feeding arm 55 on the right hand is in the erected state.

As the film feeding arm 55 in the erected state begins to rock toward the fall-down state as shown in FIG. 6(D), the continuous bag-shaped member 2 is guided around the openable vanes 102 on the right side, and the continuous bag-shaped member 2 supplied from the tension adjusting mechanism 20 is guided to the folded end position on the left side by the end push plate 56 on the forward end of this film feeding arm 55. Additionally, at this time, the film feeding arm 55 on the left side has been rocked from the fall-down state to the erected state.

Upon completion of a fall-down of the film feeding arm 55 on the right side, a state similar to the state shown in FIG. 6(A) is brought about. Thereafter, the same operations as described above are repeated, and the continuous bag-shaped member 2, which has been successively folded to a predetermined folding width in a Z-shaped manner, are accumulated in layers on the bearer 61 of the stacking mechanism.

As the rocking operations by the pair of the film feeding arms 55 as described above are repeated, the central portion of the continuous bag-shaped member 2 on the bearer 61 of the stacking mechanism is pressed by the keep plate 58 each time the film feeding arm 55 falls down, whereby the insert members 62 are reliably inserted through the superposed linear cuts 5, so that the continuous bag-shaped member 2 clamped between the openable vanes 102 and the folded end receiving member 104 is given a suitable tension, thereby reliably forming the folds on the continuous bag-shaped member 2.

Furthermore, the length of the continuous bag-shaped member 2 across the bag making machine 10 and the folding apparatus 40 is adjusted by positionally adjusting the position adjusting roll 16 in the horizontal direction. By this adjustment in length of the continuous bag-shaped member 2, the positions of the linear cuts 5 of the continuous bag-shaped member 2 placed in layers on the bearer 61 can be accurately superposed on one another.

In the continuous bag-shaped member 2 between the bag making machine 10 and the folding apparatus 40, the looseness which otherwise would occur therein can be effectively avoided by the dancer 21 and the reversing roller 22 for causing the dancer 21 to move (return) at higher speed, whereby no wrinkles and the like occur.

The above-described embodiment is advantageous in the following respects.

Such an arrangement causes the continuous bag-shaped member 2 to be alternately guided from either side by the pair of the film feeding arms 55 repeating the rocking operations and finally to be supplied to the folded end position, so that all of the elements necessary for the provision of the mechanisms to convert the rotary motion into the liner reciprocatory motion are eliminated. The mechanism allows the supplying mechanism and the folded end holding member to operate while avoiding a collision with each other. As a consequence, the general arrangement of the apparatus can be extremely simplified, whereby the operations of the apparatus as a whole can be also simplified. For this, the advantage results in that operations at a speed higher than the known apparatus can be achieved, thus increasing the folding speed.

Furthermore, advantages result in that the number of parts is reduced to a considerable extent, whereby the parts can be increased in size and mechanical strength, so that the apparatus can be improved in mechanical strength and sufficient forces can be applied to the parts, thus enabling the achievement of reliable folding operations. Moreover, the apparatus is generally improved strength, so that the apparatus can sufficiently bear the high speed operation, thereby further improving the folding speed from this respect.

Since the arrangement is simplified, a possibility of causing a malfunction is eliminated, and the controllability is improved. Furthermore, noises, vibrations and the like can be reduced.

Further, as the film feeding arm 55 guides the continuous bag-shaped member 2 to the folded end position, the folded end push plate 56 acts on the continuous bag-shaped member 2 in a manner to give a suitable tension to and wipe (smooth out wrinkles) the continuous bag-shaped member 2, whereby the folding accuracy for the continuous bag-shaped member 2 is improved, so that the continuous bag-shaped member 2 can be folded in a clean state, and folded accurately to a predetermined folding width free of wrinkles.

Furthermore, the film feeding arms 55, openable vanes 102 and the like in a unitary structure are mounted on the base blocks 96, respectively, whereby, when the two base blocks 96 on the right and left sides are moved in the horizontal direction to change the interval between the two base blocks 96, the continuous bag-shaped member 2 can be folded to any one of various folding widths, thus proving to be greatly convenient.

In the proposed apparatuses, the insert members of the stacking mechanism have been vertically moved at a suitable timing because the supplying mechanism reciprocates between the two folded end positions and the insert members should be reliably inserted through the web-shaped member. However, in this embodiment, the continuous web-shaped member 2 is supplied to the folded end positions by the film feeding arms 55 and the insert members 62 are forcedly inserted through the linear cuts 5 by the keep plates 58 secured to the film feeding arms 55, respectively, so that there is no need of vertically moving the insert members 62 in operational association with the timing of the folding operation of the folding apparatus 40. In consequence, the stacking mechanism is also simplified in construction.

In working the present invention, the folded end receiving member 104 in the above embodiment need not necessarily be provided, however, the provision of the folded end receiving member 104 makes it possible to firmly clamp the continuous web-shaped member 2 at the folded end position between this receiving member 104 and the openable vanes 102. The folded end portion is formed as a fold on the bag-shaped member 2 and the like, thus reliably folding the bag-shaped member 2.

Furthermore, the openable vanes 102 have been used as the folded end holding members, however, the folded end holding members may be rod-shaped and the like. The folded end holding members need not necessarily be rotational, but may be insertable in the horizontal direction. Further, the folded end holding members need not necessarily be provided at both sides of the folded end position, but may be provided only on one side. In short, any one, around which the web-shaped member is guided and which can hold the folded end portion from inside of the folded end portion, can be utilized.

Such an arrangement may be adopted that the mounting pins 57 are made linearly movable, with their outgoing values toward the bearer 61 being regulated, and biased toward the bearer 61, and, when the positions of the linear cuts 5 are shifted from the insert members 62 for some reason or another, the keep plate 58 is not lowered, consequently, the film feeding arm 55 does not completely fall down, the mounting pins 57 are forcedly moved in a direction opposite to the bearer 61 against the biasing force, whereby, due to this movement, a switch for stopping the apparatus as a whole may be actuated. With this arrangement, when the folding position is shifted for some reason or another, an automatic stop is effected at once, so that it is convenient because defective products can be minimized in number.

Further, the folding position can be easily adjusted by the positional adjustment of the position adjusting roll 16, and hence, when the insert members 62 are not inserted through the linear cuts 5, the perforated lines 4 may be coincided with the folded end position and the like.

Furthermore, the web-shaped member need not be limited to the continuous bag-shaped member 2, but may be a web-shaped member formed of a plastic sheet. The raw material need not be limited to plastic.

In the above embodiment, the single drive shaft 41 has been mechanically connected thereto with the supplying mechanism 50 and the openable vanes 102, and these members have been operated in association with one another, however, for example, driving sources, which are independent of one another, may be provided on the supplying mechanism 50 and the openable vanes 102, respectively, and the aforesaid mechanism and vanes may be associated in operation under a sequence control.

Such an arrangement may be adopted that each keep plate 58 is formed separately of the film feeding arm 55, an arm similar to this film feeding arm 55 is provided, this arm being supported at one end by the connecting shaft 52 and secured at the other end thereto with the keep plate 58. The timing of keeping the continuous bag-shaped member 2 by the keep plate 58 formed separately of the film feeding arm 55 is determined such that, when the film feeding arm 55 is moved toward the erected state and the folded end portion formed by the end push plate 56 on the forward end of the film feeding arm 55 is guided around the openable vanes 102 and clamped with the folded end receiving member 104, the keep plate 58 may press the continuous bag-shaped member 2 alone. With this arrangement, when the continuous bag-shaped member 2 is pressed by the keep plate 58, the two ends of the continuous bag-shaped member 2 are reliably clamped between the openable vanes 102 and the folded end receiving member 104, whereby, even if the pressing speed of the keep plate 58 is increased, the continuous bag-shaped member 2 can be inserted therethrough with the insert members 62 with the continuous bag-shaped member 2 not being pulled out from the sides of the bag making machine 10 and the stacking, so that the folding apparatus can be advantageously operated at high speed with the accuracy in the dimension of the folding width being maintained.

Further, in the above embodiment, downwardly of the folding section, there is provided a drive link mechanism for driving the film feeding arms 55, openable vanes 102 and the like, including a link mechanism starting from the drive shaft 41, passing through the rotary cam plate 42, first driving rod 44, etc. and terminating at the arm driving rod 49 and another link mechanism starting from the drive shaft 41, passing through the cam 43, connecting rod 73, rocking rods 76, 77, etc. and terminating at the parallel rods 82, 83. However, positioning this drive link mechanism upwardly of the openable arms 101 may result in the advantage that the after-treatment, such as the removal of the folded continuous bag-shaped member 2 from the bearer 61, is facilitated.

Furthermore, in the above embodiment, the continuous bag-shaped member 2 is folded in large quantities by the descend of the bearer 61. However, when the continuous bag-shaped member 2 thus folded in large quantities is partially separated and packed in a case at every predetermined number of sections, e.g. 100 sections, a label is stuck or a piece of cardboard is inserted every predetermined number of sections. While the continuous bag-shaped member 2 is folded in large quantities, the continuous bag-shaped member 2 may be cut off with the label or cardboard as the guide. In this case, the heat cutter 12 of the bag making machine 10 is moved in the cut-in direction greater than the ordinary case at every predetermined number of sections, whereby the perforated lines 4 are formed to be large in size, so that the perforated lines 4 may be easily torn. Furthermore, instead of using the labels and the like, a heat cutter for forming a mark is provided separately of the aforesaid heat cutter 12, and, if this heat cutter is provided at a position spaced one half of the holding width apart from the aforesaid heat cutter 12, then perforated lines for cutaway purposes are formed by this heat cutter for providing a mark just at the folded end position, and hence, the advantages result in that, if the folded end portion is inspected, a cutaway position may be readily found and auxiliary materials such as the labels and the like may be dispensed with. On the other hand, there is presented the disadvantage that a bag should be sacrificed for this purpose.

Further, in the above embodiment, when the lateral width of the continuous bag-shaped member 2 is large and the handling of the bag-shaped member 2 after the folding is troublesome, the bag-shaped member 2 may be folded in two or thirds in the longitudinal direction thereof and thereupon folded by the folding apparatus 40 according to the present invention. In this case, as the means for folding in the longitudinal direction, a guide plate being of a V-shape in cross section is used, and the central angle of the V-shape of this guide plate is progressively decreased from the side of inserting the continuous bag-shaped member 2 to the side discharging the same, whereby the bag-shaped member 2 may be folded along the center line of the widthwise direction of the bag-shaped member 2. Or, each one of the guide plates being of a V-shape in cross section, in which the central angle of the V-shape is progressively decreased, is provided at each of opposite side edges of the bag-shaped member 2, whereby two guide plates provided at the opposite side edges cooperate in folding $\frac{1}{4}$ of the lateral width of the bag-shaped member 2 from the opposite sides, respectively, so that the bag-shaped member 2 having a $\frac{1}{2}$ width may be formed. Furthermore, according to this method of providing the guide plates at the opposite side edges, when the folding width is made $\frac{1}{3}$, a three-folded bag-shaped member 2 is obtainable. When double-folding is repeated twice by use of the aforesaid one guide plate or the opposing guide plates, a four-folded bag-shaped member 2 is obtainable. Similarly, the two methods described above are suitably combined with each other, so that any continuous bag-shaped member having a desirable lateral width may be formed and supplied to the folding apparatus 40. Further, this mechanism for changing the lateral width may be disposed at any position only if the position is located downstream of the bag making machine 10 and upstream of the folding apparatus 40. In other words, the mechanism may be disposed at any position prior or posterior to the tension adjusting mechanism 20.

FIGS. 7 to 19 illustrate various embodiments of one set folding method, which are each combined with the folding apparatus 40 shown in the above embodiment and in which the continuous bag-shaped member 2 is cut off at every predetermined number of sections and taken out as one set.

Figure 7:
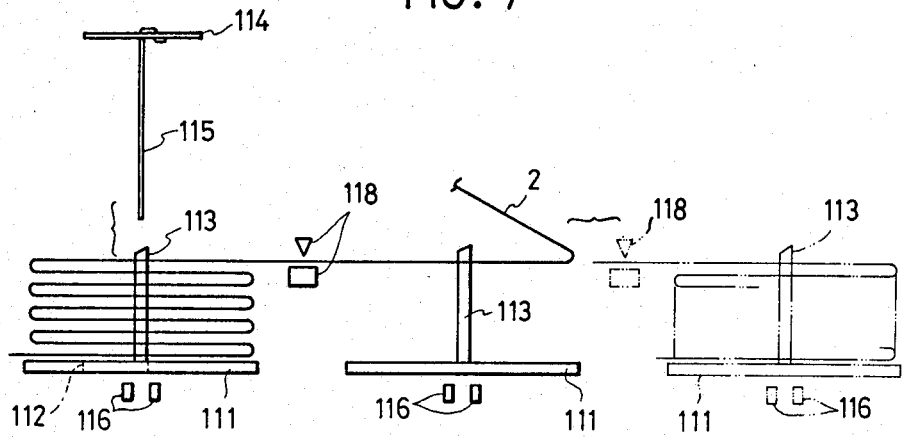
FIG. 7 is a schematic view showing one embodiment of the method of folding one set of the continuous bag-shaped member.
Figure 8:
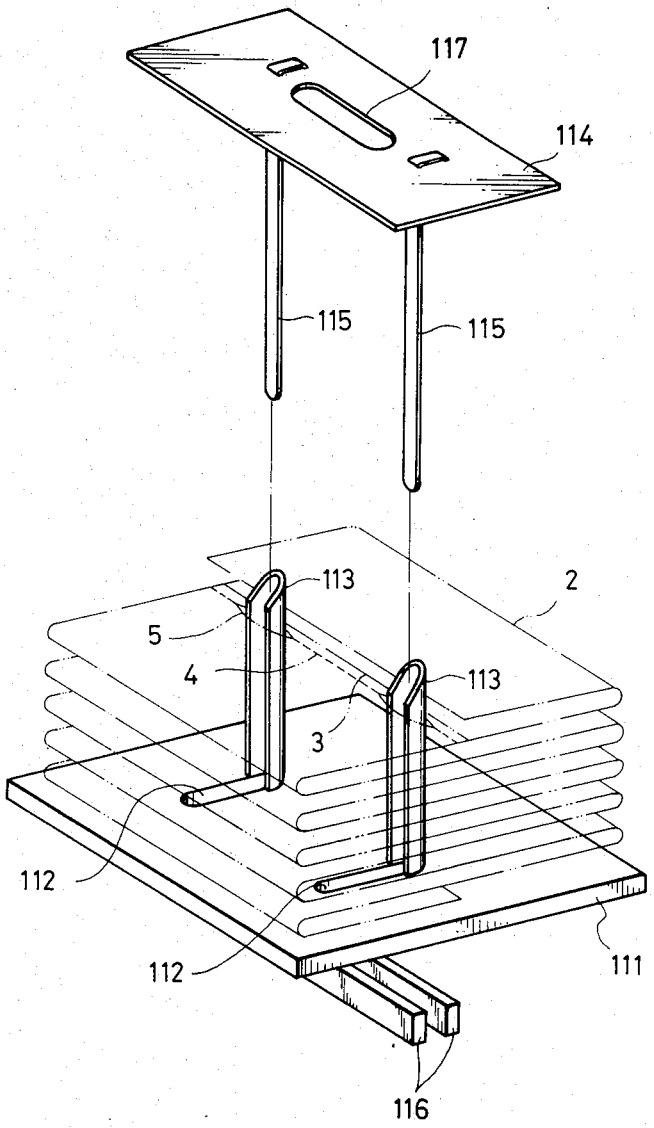
FIG. 8 is an enlarged perspective view showing the essential portions of FIG. 7.

FIGS. 7 to 9 show one embodiment of one set folding method, in which embodiment, as shown in FIG. 7, there are provided two bearers 111, in each of which the continuous bag-shaped member 2 is folded, and these bearers 111 alternately move between the central position of the folding and a position where each bearer 111 does not interfere with the folding operation upon completion of the folding of every predetermined number of sections of the continuous bag-shaped member 2. Each bearer 111 is formed therein with a pair of slots 112 being spaced a predetermined distance apart from each other as shown in FIG. 8 and each slot 112 is provided at an end portion thereof with an erected insert member 113. Each insert member 113 is formed of a U-shaped member having a groove width substantially equal to a groove width of each slot 112 and the forward end of each insert member 113 is obliquely cut away, so as to be easily inserted into the linear cut 5 formed in the portion of the perforated lines 4.

Each insert member 113 is inserted therethrough with a tying member 115 secured at the top end thereof to a plate member 114 formed of a cardboard material or the like. The bottom end portion of this tying member 115 is extended through the slot 112 of the bearer 111 and projected from the bearer 111 downwardly. This tying member 115 is formed of a vinyl tape reinforced by flexible wire. A bending member 116 formed of a pair of linear materials are provided at positions where the bottom end portions of the tying members 115 are projected from the bearer 111. When the bottom end portions of the tying members 115 are inserted between the pair of linear materials of the bending member 116, the bending member 116 is driven to bend the bottom end portion of the tying member 115 in the longitudinal directions of the slots 112.

The plate member 114 is formed at the central portion thereof with a pull-out hole 117, through which the continuous bag-shaped member 2 can be pulled out one bag after another.

Additionally, the bearers 111 are reversibly provided, and a cutter 118 for the continuous bag-shaped member 2 is interposed between the two bearers 111.

Description will hereunder be given of action of this embodiment with reference to FIGS. 9(A) to 9(D).

Figure 9A:
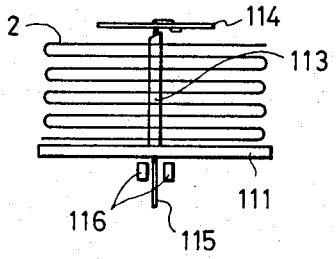
FIGS. 9(A) to 9(D) are views illustrating the embodiment in FIG. 7 in actuated positions.
Figure 9B:
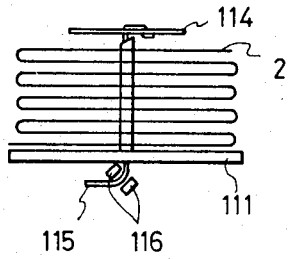
Figure 9C:
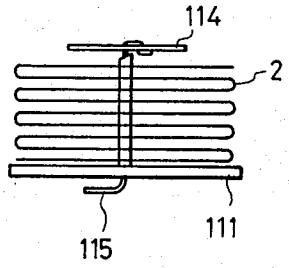
Figure 9D:
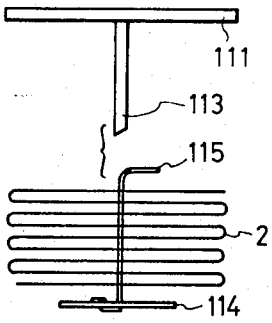

Referring to FIG. 7, when a predetermined number of sections of the continuous bag-shaped member 2 are folded on the bearer 111, the bearer 111 is moved from the folding position to a position where the bearer 111 does not interfere with the folding operation, the continuous bag-shaped member 2 is cut off by the cutter 118, the tying members 115 are automatically or manually inserted through the insert members 113, respectively, in this state, and the bottom end portions of the tying members 115 projecting downwardly are shown in FIG. 9(A). Subsequently, the bottom end portions of the tying members 115 bent by the bending members 116 are shown in FIG. 9(B). Upon completion of the bending of the bottom end portions of the tying members 115, the bending member 116 is drawn in the longitudinal direction thereof, whereby the bending member 116 does not interfere with the tying members 115 moving into the slots 112 in the bearer 111. When the bearer 111 is reversed in this state, a predetermined number of sections of the continuous bag-shaped member 2 being tied by the tying members 115 are taken out as one set as shown in FIG. 9(D). The bag-shaped member 2 being tied into one set is contained in a cardboard box similar to a tissue paper box to be produced as a product. With this product, a first section of the continuous bag-shaped member 2 is pulled out of the pull-out hole 117 of the plate member 114, the first section of the bag-shaped member 2 is cut away from the perforated lines 4 between the first and the second sections by the tying members 115 since the tying members 115 are inserted through the linear cuts 5 between the first and the second sections, so that only the first section can be taken out. In this case, when the first section is cut away from the perforated lines 4, the forward end portion of the second section is torn off in such a manner that the forward end portion of the second section engages the tying members 115 by the tensile force of the first section of the bag-shaped member 2, whereby, at the time of being torn off, the forward end portion of the second section of the bag-shaped member 2 is partially pulled out of the pullout hole 117, and, when the bag-shaped member 2 is used next time, the partially pulled out portion is grasped and readily pulled out.

Figure 11:
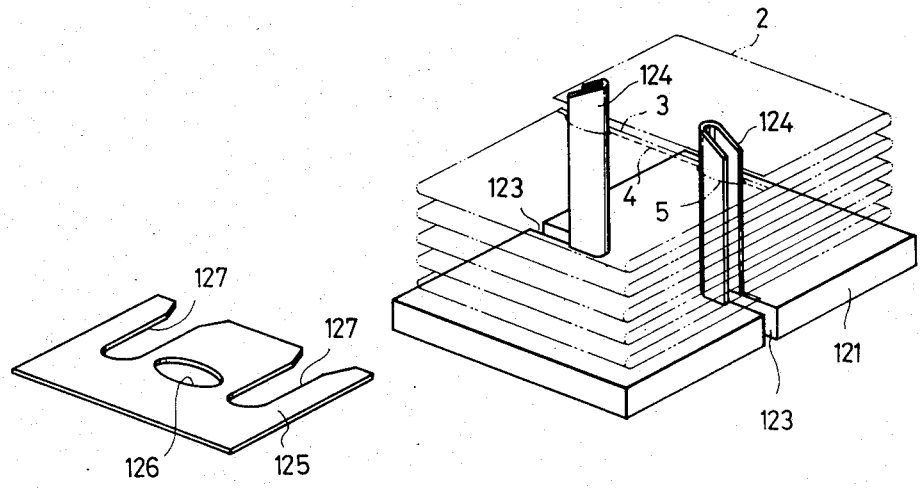
FIG. 11 is an enlarged perspective view showing the essential portions of FIG. 10.
Figure 12:
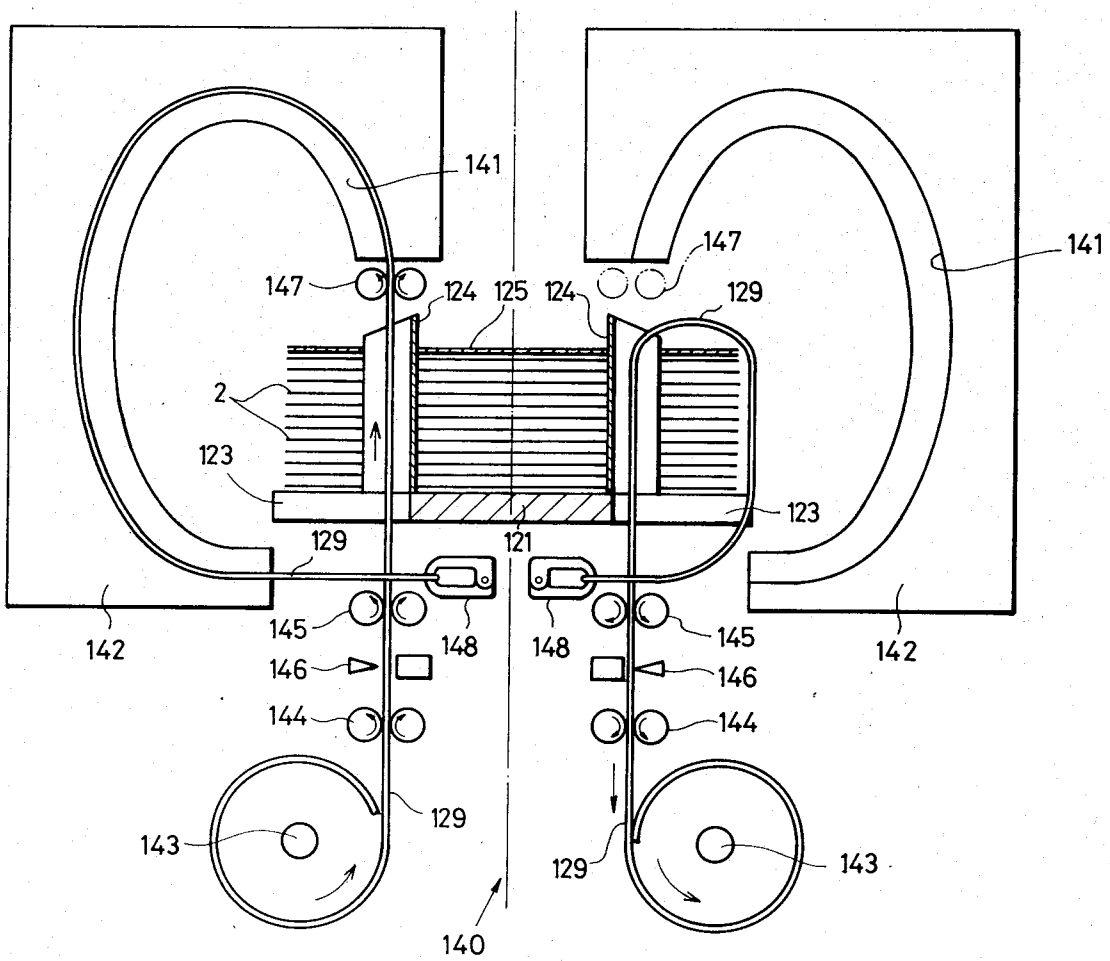
FIG. 12 is a sectional view showing an example of a tying device used in the embodiment shown in FIG. 10.

FIGS. 10 to 12 show another embodiment of one set folding method, in which two bearers are used and one set as a whole is tied by means of a tying mechanism. More specifically, in FIG. 10, a pair of bearers 121 are supported by a connection supporting mechanism 122, made movable from the folding positions to positions where the bearers do not interfere with the holding operations, and made reversible. As shown in FIG. 11, each bearer 121 has a pair of U-shaped grooves 123 at a position facing toward the central portion of the folding width of the continuous bag-shaped member 2 having a sealed portion 3, perforated lines 4 and linear cuts 5, further, insert members 124 are erected at the deepest portions of the U-shaped grooves 123, respectively, these insert members 124 are each formed into a U-shaped cross section, openings of the U-shapes of the insert members 124 are provided in the same directions as the openings of the U-shaped grooves 123, i.e. in the widthwise direction of the bag-shaped member 2, and the forward end portions of the insert members 124 are sharpened, respectively, so that the insert members 124 can be readily inserted through the linear cuts 5 of the bag-shaped member 2 when the bag-shaped member 2 is folded on the bearer 121.

Upon completion of the folding of the predetermined number of sections of the continuous bag-shaped member 2 on the bearer 121, a plate member 125 formed of a cardboard material is inserted onto the top surface of the bag-shaped member 2 from the horizontal direction. As shown in FIG. 11, this plate member 125 is provided at the central portion thereof with a pull-out hole 126 and has two U-shaped cut-ins 127 for avoiding interference with the insert members 124.

With the above-described embodiment, the folding operations of this embodiment will now be described with reference to FIGS. 10(A) to 10(D).

In FIG. 10(A), when a predetermined number of sections of the continuous bag-shaped member 2 are folded on one of bearers 121 in the left in the drawing, the connection supporting mechanism 122 is moved to the left, the bearer 121 in the left is removed from the folding position as shown in FIG. 10(B), and the other of bearers 121 is positioned in the folding position. In this state, the plate member 125 is supplied onto the bag-shaped member 2 on the bearer 121 in the left, a portion of the bag-shaped member 2, which has not yet been folded, is drawn out to the bearer 121 in the right, and the aforesaid portion is successively folded on the bearer 121 in the right. In this case, after at least one section of the bag-shaped member 2 is folded on the bearer 121 in the right, a portion connecting the bag-shaped member 2 on the bearer 121 in the left to the bagshaped member 2 on the bearer 121 in the right is cut off by a cutter 128.

Subsequently, as shown in FIG. 10(C), after tying members 129 each formed of a vinyl tape reinforced by flexible wire, or the like are inserted through the respective insert members 124, and end portions of the tying members 129 drawn outwardly from opposite sides in the widthwise direction of the bag-shaped member 2 are connected to each other, whereby the predetermined number of sections of the bag-shaped member 2 are tied up together with the plate member 125 to be formed into one set. Thereafter, the bearer 121 in the left is reversed, one set of the bag-shaped member 2 is removed from the bearer 121 and dropped onto a carry-out conveyor belt 130 disposed under the both bearers 121, and conveyed to a required place.

FIG. 12 shows an example of a device for tying the bag-shaped member 2 by use of the tying member 129 in FIG. 10(C) above. In FIG. 12, the left half portion from the center line shown by one-dot chain line shows the state immediately after the tying member 129 is disposed in a loop form, and the right half portion shows the stage immediately before the tying member 129 is retracted for the tying, the loop form is reduced in size and the tying member 129 is about to be cut off by a required length. In this drawing, the tying device 140 includes: a pair of guide blocks 142 having guide grooves 141 provided at opposite side positions of the bearer 121 in a manner to cover the opposite end edges of the bearer 121. The guide grooves 141 are generally C-shaped and inverted C-shaped for curling the tying members 129 into loop forms, respectively; drums 143 normally or reversely rotatable are provided at positions spaced downwardly of the respective guide blocks 142 and the tying members 129 are guide therearound; a set of pairs of drive rollers 144 are provided for conveying the tying members 129 drawn out of the drums 143 in the drawn-out direction or in the rewinding direction; a set of pairs of openable pinch rollers 145 are provided for delivering into or retracting from the respective insert members 124 erected on the bearer 121 the tying members 129 conveyed by the drive rollers 144; cutters 146 are interposed between the drive roller 144 and the pinch roller 145, for cutting off the tying members 129 at predetermined positions, respectively; drivable takeup rollers 147 are provided for taking up the tying members 129 after having passed through the insert members 124, sending out the same along guide grooves 141 of guide blocks 142, and further, being movable in a direction perpendicular to the to the plane of the drawing to avoid interfering with the tying member 129 when the tying member 129 is formed into a small loop as shown in the right half portion of FIG. 12; and grip means 148 facing toward the terminal ends of the guide grooves 141 of the guide blocks 142 on the side of delivering the tying members 129, for gripping the end portions of the tying members 129 delivered from the aforesaid terminal ends.

With the above-described arrangement, to tie the folded predetermined number of sections of the continuous bag-shaped member 2, as shown in the left half portion of FIG. 12, the drum 143 and drive rollers 144 are driven in the direction of sending out the tying member 129, the tying member 129 is inserted into the inset member 124 through the pinch rollers 145 and further taken up by the takeup rollers 147, the tying member 129 is sent out along the guide groove 141 of the guide block 142 to be formed into the loop form surrounding the side edge of the bagshaped member 2, and delivered from the terminal end of the guide groove 141 to be gripped by the grip means 148. Needless to say, in this case, the mechanism shown in the right half portion of FIG. 12 is operated simultaneously with and similarly to the above.

Subsequently, as shown in the right half portion of FIG. 12, the takeup rollers 147 are moved in the direction perpendicular to the plane of the drawing so as to avoid interfering with the tying member 129 forming the small loop. In this state, the drum 143 and drive rollers 144 are driven in the reverse direction to retract the tying member 129 to form the same into the predetermined small loop. In this state, an intersection formed between the tying members 129 is fixed by the fusion bonding of the tying member to each other by use of well-known fusion bonding means, not shown, or by twistingly connecting the tying members to each other by the swinging of the grip means 148 around the tying members 129 extended in the vertical direction in the drawing. Subsequently, the tying members 129 are cut off by the cutters 146. In this case, the tying members 129 may be connected to each other to be fixed after the tying members 129 are previously cut off by the cutters 146.

In addition, in this embodiment, to form the tying member 129 into the small loop, the drum 143 has been rotated in the reverse direction, however, needless to say, a link mechanism used in an ordinary tying device may be utilized for this purpose.

FIGS. 13 to 16 show a further embodiment of the one set folding method.

Figure 13:
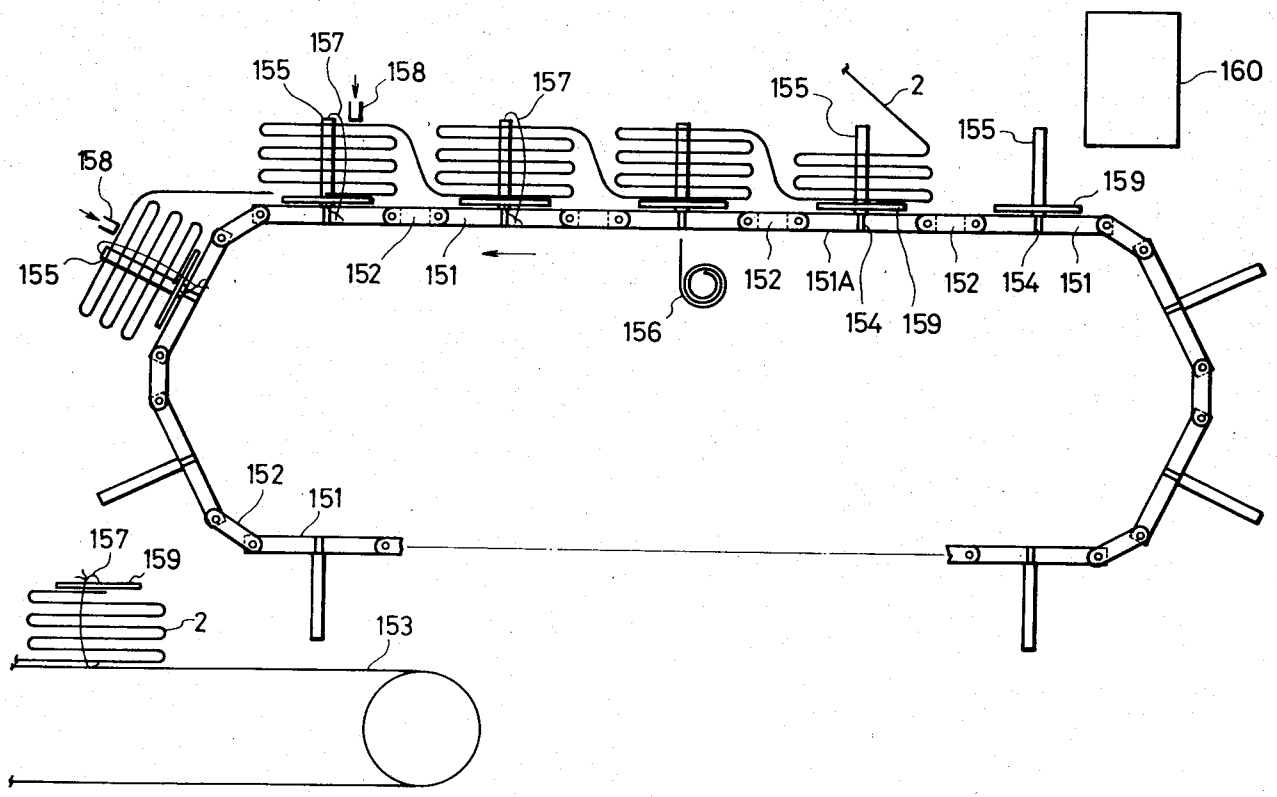
FIG. 13 is a schematic view showing a further embodiment of a one set folding method.

In the embodiment shown in FIG. 13, bearers are endlessly connected to one another. More specifically, a multitude of bearers 151 are endlessly connected to one another through connecting members 152, and a carry-out conveyor belt 153 is disposed downwardly of the endlessly connected bearers 151. Each bearer 151 is constructed similarly to that in the embodiment shown in FIG. 11, having the pair of U-shaped grooves 154 and the pair of insert members 155.

A tying device 156 having a construction identical with that shown in FIG. 12 is provided at a position of the bearer 151 one stage behind the bearer 151A positioned at a position, where the continuous bag-shaped member 2 is folded, out of the endlessly connected bearers 151, whereby one set of the bag-shaped member 2 may be tied up by tying members 157 in the same manner as in FIG. 12.

Furthermore, fixing means 158 for pressingly fixing the bag-shaped member 2 to the bearers 151 is provided at positions in front and behind of a position where the endlessly connected bearers 151 turn obliquely downwardly from the horizontal direction. This fixing means 158 is adapted to move in synchronism with the bearer 151 with the bag-shaped member 2 being fixed and to pressingly fix the bag-shaped member 2 at one side relative to the insert members 155 erected on the bearer 151, i.e. in the right in the drawing, whereby, when the bearers 151 disposed adjacent to each other turn around a corner portion where both bearers are inclined to each other at a predetermined angle, since the bag-shaped member 2 folded on the forward and the rearward bearers 151 is continued from the top positions of the forward insert members 155 to the bottom positions of the rearward insert members 155, the continued portion is varied in length, so that the bag-shaped member 2 is cut off at the portion of the perforated line, where the insert members 155 are inserted therethrough. Additionally, the fixing means 158 may be one separately provided along the bearer 151, or may be of such an arrangement that the fixing means is provided on each bearer 151, adapted to stand by in a position of not interfering with the folding operation at the time of the folding operation and the like and to move to pressingly fix the bag-shaped member 2 when necessary.

Figure 14:
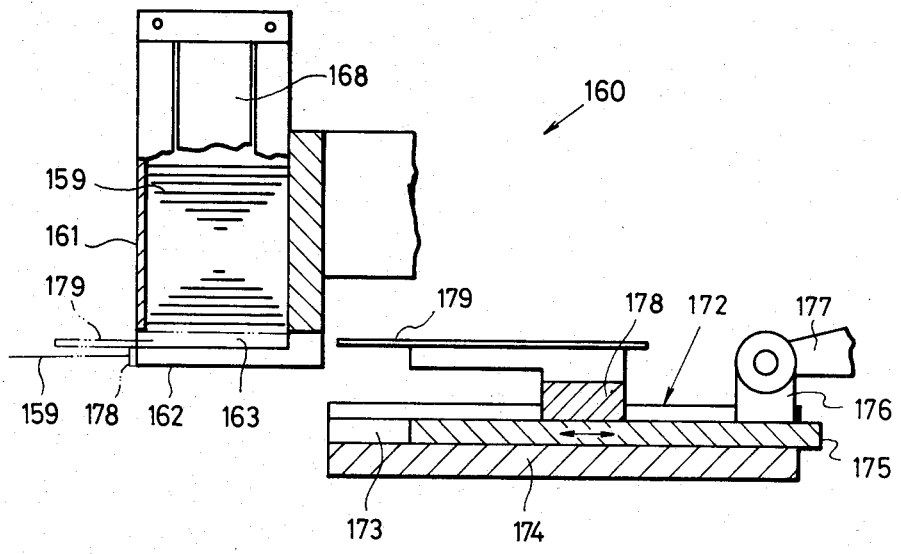
FIG. 14 is a partially sectioned side view showing an example of the plate-shaped member supplying mechanism used in the embodiment shown in FIG. 13.
Figure 15:
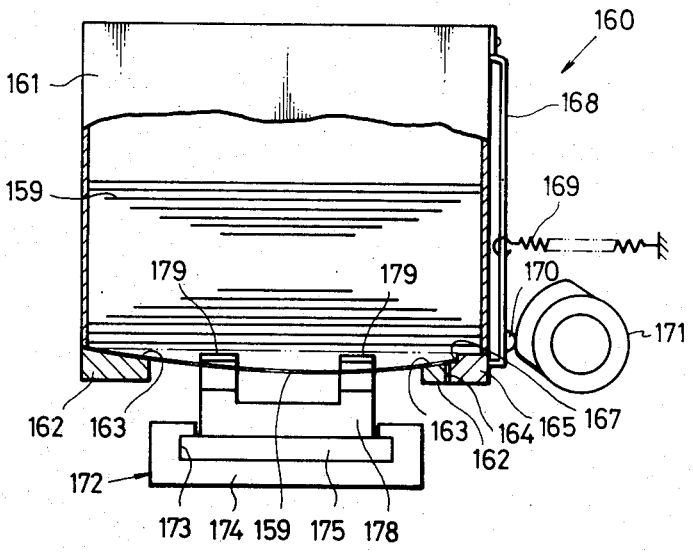
FIG. 15 is a partially sectioned front view of FIG. 14.
Figure 16:
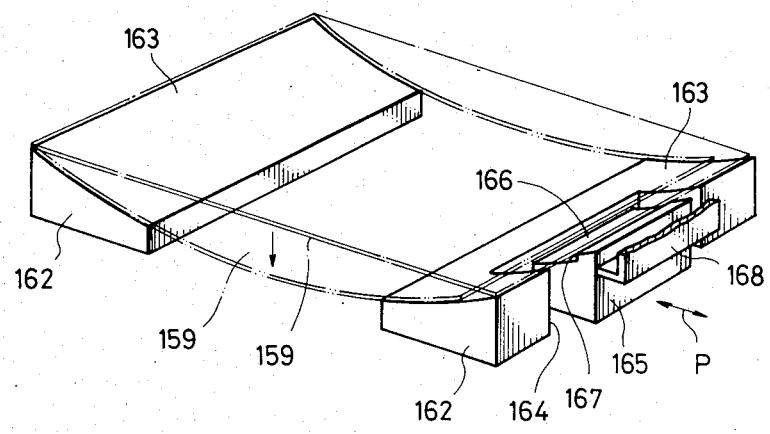
FIG. 16 is an enlarged perspective view showing the essential portions of FIG. 15.

At a position upwardly of the bearer 151 one stage before the bearer 151A at the folding position, there is provided a plate member supplying device 160 for supplying a plate member 159 similar to that shown in FIG. 11 to the bearer 151 passing through the stage. The construction of this supplying device 160 is shown in detail in FIGS. 14 to 16. In FIG. 14, there is shown a partially cut away side view, in which, in a container 161, a multitude of plate members 159 are contained. The bottom of the container 161 is opened downwardly, and edge portion receving members 162 are fixed to opposite sides of the bottom face of this container 161. As shown in FIGS. 15 and 16, these receiving members 162 are each formed at the top surface, i.e. the surface facing toward the interior of the container 161 with receivingly mounting surface 163 being downwardly curved. Furthermore, a cutaway portion 164 is formed in the central portion of one of the receiving member 162, i.e. the receiving member 162 shown in the right in FIG. 16, and, in this cutaway portion 164, there is provided a curvedly operating member 165 in a manner to be linearly movable in a direction indicated by an arrow P. When moved to a position inwardly of the cutaway portion 164, the curvedly operating member 165 is provided at the upper inner surface thereof with a receivingly mounting surface 166 being equal in height to the receivingly mounting surface 163 of the receiving member 162 and formed at a portion outwardly of this receivingly mounting surface 166 with a stepped portion 167 having a height corresponding to one plate thickness of the plate member 159. This curvedly operating member 165 is fixed at the top end thereof to the bottom end of a flexible support plate 168 fixed to the upper portion of the side surface of the container 161. This support plate 168 is biased outwardly by a tension spring 169, a semispherical cam follower 170 formed on the bottom end of the support plate 168 is constantly brought into abutting contact with a cam 171 by the biasing force of this spring 169, and the support plate 168 is rocked as the cam 171 is driven, to thereby linearly move the curvedly operating member 165 in the direction indicated by the arrow P in the cutaway portion 164.

A mechanism 172 for delivering the plate member 159 is provided behind the container 161. This delivering mechanism 172 includes: a guide member 174 having a guide groove 173; a slider 175 slidable in the guide groove 173 of this guide member 174; a connecting rod 177 connected at one end thereof through a bracket 176 to this slider 175 and at the other end thereof to a crank mechanism, not shown, for linearly moving the slider 175 as the crank mechanism is driven; a delivery member 178 erected on the slider 175, capable of coming in abutting contact at the forward end thereof with one plate member received at the bottom of the container 161 and adapted to curve downwardly as the curvedly operating member 165 moves inwardly, and delivering the plate member 159 to the outside of the container 161 when the slider 175 moves to the left in FIG. 14; and a pair of plate-shaped partitioning members 179 fixed to bifurcated top end portions of this delivery member 178, respectively, extended from the forward end portions of the delivery member 178, and made insertible between the curved plate member 159 at the bottom and a plate member immediately above the curved plate member 159 to thereby prevent the plate member 159 of the second from the bottom and thereabove from dropping downwardly when the plate member 159 is delivered to the outside by the delivery member 178.

Description will hereunder be given of action of this embodiment.

In the plate member supplying mechanism 160, when the support plate 168 is moved inwardly against the biasing force of the tension spring 169 as the cam 171 is driven, the curvedly operating member 165 is moved inwardly. Due to this movement of the curvedly operating member 165, the plate member 159 at the bottom engaged at one side edge thereof with the stepped portion 167 of the curvedly operating member 165 is deformed to a position curved downwardly along the receivingly mounting surfaces 163 of the both receiving members 162, which is indicated by two-dot chain lines from the horizontal position indicated by one-dot chain lines in FIG. 16, whereby only the plate member 159 at the bottom is separated from other plate members 159.

In this state, when the connecting rod 177 is driven and the delivery member 178 and the partitioning member 179 are moved to the left in FIG. 14 through the slider 175, the plate members 159 of the second from the bottom and thereabove are prevented from dropping by the partitioning member 179, the plate member 159 at the bottom is delivered to the outside by the forward ends of the delivery member 178, and supplied onto the bearer 151 as shown in FIG. 13. Needless to say, in this case, the plate member 159 is supplied with the plate member being positioned such that the U-shaped grooves formed in the plate member does not abut against the insert members 155.

The bearer 151 thus supplied with the plate member 159 is intermittently delivered to the subsequent stage, i.e. the folding position, where a predetermined number of sections of the bag-shaped member 2 are folded, and thereafter, delivered to the following stage, where the bag-shaped member 2 is tied up by the tying device 156. When delivered to the next stage, the bag-shaped member 2 has its right half portion pressingly fixed by the fixing means 158. In this state, the bag-shaped member 2 is moved as the endlessly connected bearers 151 move, and, when the bearers 151 disposed adjacent to each other are inclined to each other, turning around a corner, the bag-shaped member 2 is separated into every sets as described above. One set of the bag-shaped member 2 thus separated is dropped from the bearer 151 onto the carry-out conveyor belt 153 as the bearer 151 moved downwardly, and carried out to a predetermined position.

This embodiment as described above is advantageous in that the continuous bag-shaped member 2 of a one set folding method can be produced more smoothly and continuously than ever.

Figure 17:
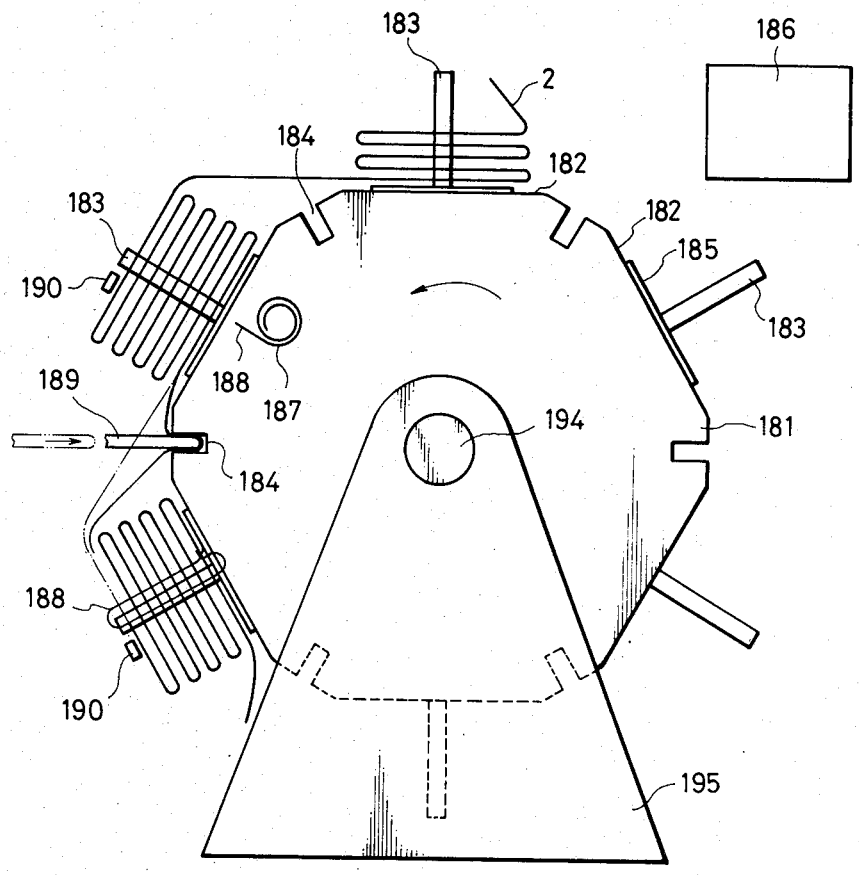
FIG. 17 is a side view showing a still further embodiment of a one set folding method.
Figure 18:
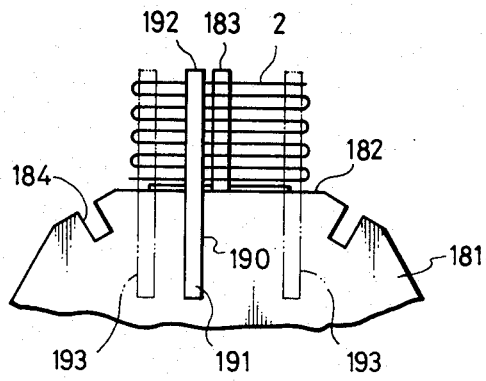
FIG. 18 is a side view showing a construction of the fixing means in the embodiment shown in FIG. 17.
Figure 19:
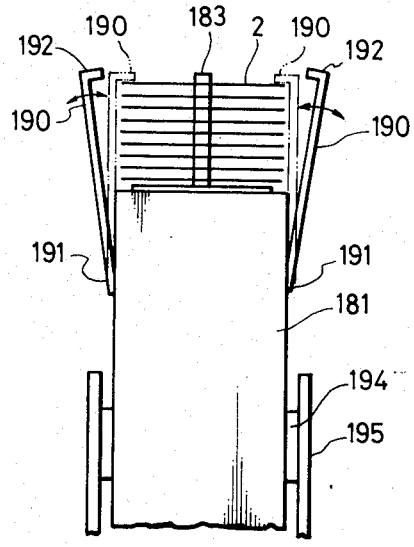
FIG. 19 is a front view of the embodiment shown in FIG. 17.

FIGS. 17 to 19 show a still further embodiment of a one set folding method, in which a polygonal drum is used. More specifically, in FIG. 17, the polygonal drum 181 is provided on the peripheral surface with polygonal, e.g. hexagonal receiving surfaces 182, a pair of insert members 183 are provided in the central portions of these receiving surfaces 182, and grooves 184 for cutting off the continuous bag-shaped member 2 into sets are formed at corner portions connecting the receiving surfaces 182. Furthermore, a plate member supplying mechanism 186 similar to that shown in FIGS. 14 to 16, for supplying plate members 185 is provided at a stage just this side of the folding position of the drum 181. Provided at a stage on the other side of the folding position are tying device 181 similar to that shown in FIG. 12, made linearly movable from opposite sides of the drum 181 and toward the drum 181, avoiding interfering with the rotation of the drum 181, and capable of tying the bag-shaped member 2 by use of tying members 188.

Further, a plate-shaped engage member 189 capable of being inserted into the groove 184 is interposed between the tying stage and the subsequent stage. This engage member 189 is inserted into the groove 184, so that the continuous bag-shaped member 2 connected between the tying stage and the stage can be cut off. In this case, at the stages adjacent to each other, interposing the engage member 189, the left sides of the insert members 183 of the bag-shaped member 2 are pressingly fixed to the receiving surface 182 by the fixing means 190, and, due to the increase in tension by the insertion of the engage member 189, the bag-shaped member 2 is cut off. As shown in FIGS. 18 and 19, the fixing means 190 is rockingly supported at the proximal end portion 191 thereof by the side surface of the drum 181, and rockingly driven by a driving source such as a cylinder, not shown. The forward end portion 192 of the fixing means 190, being bent into an L-shape is driven toward the center in the widthwise direction of the drum 181, so that the bag-shape member 2 can be pressingly fixed, while, the forward end portion 192 is driven in a direction opposite to the above, so that the forward end portion 192 can avoid interfering with the folding operation. Additionally, members 193 indicated by two-dot chain lines in FIG. 18 are end fixing members provided on the drum 181 as necessary, has a construction similar to that of the fixing means 190, and capable of pressingly fixing the folding end positions at opposite sides of the bag-shaped member 2, so that the folding end portion of the bag-shaped member 2 can be prevented from flapping during rotation of the drum 181.

The drum 181 is rotatably supported by a frame 195 through a center axis 194 and intermittently driven by a driving source, not shown, through an angle formed between the receiving surfaces 182, i.e. 60° in the embodiment as shown.

With the above-described embodiment, as the drum 181 is intermittently driven, the receiving surface 182 thus supplied with the plate member 185 from the plate member supplying mechanism 186 is moved to the folding position, where the continuous bag-shaped member 2 is successively folded. Upon completion of the folding of the predetermined number of sections of the bag-shaped member 2, the bag-shaped member 2 is intermittently moved to the tying stage, where one set of the bag-shaped member 2 is tied up by use of tying members 188 in a tying device 187. In this tying stage, the fixing means 190 is driven, the bag-shaped member 2 is pressingly fixed and moved to the subsequent stage as in the fixed state. In this subsequent stage, the fixed state of the bag-shaped member 2 by the fixing means 190 is held as it is, and the engage members 189 are inserted into the groove 184 in this fixed state of the bag-shaped member 2, whereby the continuous bag-shaped member 2 is cut off from the perforated lines which is not pressingly fixed, and the bag-shaped member 2 is separated into each set.

The bag-shaped member 2 thus tied up and separated into a set is removed from the insert members 183 by gravity by the release of the fixing means 190, dropped, and carried out to a predetermined position by the carry-out conveyor belt or the like, not shown. Hereinafter, the above operations are repeated and the folding operations for every sets are continuously performed.

This embodiment as described above is advantageous in that each one set of the bag-shaped member 2 can be continuously produced by use of a device rendered compact in size.

Additionally, the respective one set folding methods as illustrated in FIGS. 7 to 17, if such an arrangement is adopted that the driving link mechanism for the film feeding arms 55, openable vanes 102 and the like, which have been explained as the modification of the embodiment shown in FIGS. 1 to 6, is provided upwardly of the openable arms 101, then each of the devices of the respective one set folding methods can be readily assembled in downwardly of the folding device 40.

Furthermore, the portions projecting from the plate member of the continuous bag-shaped member 2, which are formed in the respective folding methods, may be bent on either sides of the undersurface of the plate member by use of suitable bending means, and the plate members may be conveyed in this state with the bent end portions being fastened by adhesive tapes. With this arrangement, each one set of the bag-shaped member 2 may avoid the packaging failure in the course of conveyance.

Further, folding apparatuses different from that shown in FIGS. 1 to 6 may be adopted, combining with the one set folding methods.

As has been described above, the present invention can provide an apparatus for folding a webshaped member wherein the general construction of the apparatus is simplified and the web-shaped member can be reliably and quickly folded.

What is claimed is:

1. A folding device for an elongated continuous strip of plastic web material having laterally spaced elongate cuts formed therein at regular intervals in the longitudinal direction thereof, comprising:

frame means;

a pair of spaced folded end receiving members mounted on said frame means;

means defining a pathway for said web material on said frame means;

reciprocal feed means on said frame means for feeding said continuous strip of plastic web material int zigzag manner so that web material sections are stacked one on top of the other between folded end portions thereon, said folded end portions thereon being oriented adjacent said folded end receiving members, said feed means including a pair of film feeding arms each having a proximal end and a forward end, said film feeding arms each being pivotally supported at said proximal end adjacent said folded end receiving members so that said forward ends of said film feeding arms are alternately movable to and from said folded end portions to orient said film in said zigzag manner, said film feeding arms being pivotal between an upright position inclined to the upper surface of said zigzag folded web material spacing said forward end from said folded end portions and a position parallel to the upper surface of said zigzag folded web material, each film feeding arm having intermediate said proximal end and said forward end a keep plate adapted to engage said upper surface of said web material folded in a zigzag manner, said keep plate having means defining holes therein that are alignable with said cuts when said keep plate engages said upper surface;

folded end holding members and drive means for supporting and driving said folded end holding members for movement toward and away from said folded end receiving members along at least one lateral edge of said pathway for said web material, said drive means causing, when said folded end holding members are moved away from said folded end receiving members, said folded end holding members to move out of a previously folded end of said web material to allow passage of said film feeding arms to said position parallel to said upper surface, said drive means causing, when said folded end holding members are moved toward said folded end receiving members, said folded end holding members to move into a location for guiding therearound said web material fed by said feed mechanism and effecting a tight clamping of said web material between said folded end holding means and said folded end receiving members; and receiving means for receiving said folded web material thereon in said zigzag manner, said receiving means including at least one insert member received in said aligned cuts and holes in said keep plate when said film feeding arm is in said position parallel to said upper surface.

2. An apparatus according to claim 1, wherein said receiving means comprises a plurality of receiving surfaces.

3. An apparatus according to claim 2, wherein cutting means is provided for cutting off said web material between said plural receiving surfaces.

4. A folding device as set forth in claim 3, wherein said receiving means includes a tying means for tying said web material folded on said receiving surface by use of a tying member insertable through said insert members.

5. A folding device as set forth in claim 4, wherein a pair of said receiving surfaces are provided, said receiving surfaces being movable in a horizontal direction, and wherein a cutting device is provided at an intermediate position between said receiving surfaces.

6. A folding device as set forth in claim 5, wherein:

perforated lines are formed at an intermediate portion between said folded end portions in the widthwise direction of said web material;

said cuts are each larger in width than a perforation on said perforated lines; and said insert members are erected on said receiving surfaces and are inserted through said cuts.

7. A folding device as set forth in claim 5, wherein said tying means comprises a bending member for bending the forward end portions of said tying members inserted through said insert members.

8. A folding device for an elongated continuous strip of plastic web material having laterally spaced elongate cuts formed therein at regular intervals in the longitudinal direction thereof, comprising:

frame means;

a pair of spaced folded end receiving members mounted on said frame means;

means defining a pathway for said web material on said frame means;

reciprocal feed means on said frame means for feeding said continuous strip of plastic web material in a zigzag manner so that web material sections are stacked one on top of the other between folded end portions thereon, said folded end portions thereon being oriented adjacent said folded end receiving members, said feed means including a pair of film feeding arms each having a proximal end and a forward end, said film feeding arms each being pivotally supported at said proximal end adjacent said folded end receiving members so that said forward ends of said film feeding arms are alternately movable to sand from said folded end portions to orient said film in said zigzag manner, said film feeding arms being pivotal between an upright position inclined to the upper surface of said zigzag folded web material spacing said forward end from said folded end portions and a position parallel to the upper surface of said zigzag folded web material, each film feeding arm having intermediate said proximal end and said forward end a keep plate adapted to engage said upper surface of said web material folded in said zigzag manner, said keep plate having means defining holes therein that are alignable with said cuts when said keep plate engages said upper surface; and a plurality of receiving surfaces for receiving thereon said zigzag folded web material, said receiving surfaces each having at least a pair of holes therethrough;

two rod-like insert members on each of said receiving surfaces received in said cuts in said web material in response to said keep plate pressing down on said upper surface when said film feeding arm is in said position parallel to said upper surface; and means for tying said web material in a predetermined quantity, including tying members inserted into said cuts in said web material through said insert members and a bend member for bending one end of a said tying member inserted into a superposed arrangement of said cuts.

* * * * *

UNITED STATES PATENT AND TRADEMARK OFFICE

CERTIFICATE OF CORRECTION

PATENT NO. : 4 637 812

DATED : January 20, 1987

INVENTOR(S) : Kenji Ogawa

It is certified that error appears in the above-identified patent and that said Letters Patent is hereby corrected as shown below:

Column 20, Line 50; Change "int" to ---in a---

Signed and Sealed this

First Day of September, 1987

*Attest:*

DONALD J. QUIGG

*Attesting Officer*

*Commissioner of Patents and Trademarks*